US005253625A

United States Patent [19]

Donahue et al.

[11] Patent Number: 5,253,625

[45] Date of Patent: Oct. 19, 1993

[54] INTERNAL COMBUSTION ENGINE HAVING A HYPEREUTECTIC ALUMINUM-SILICON BLOCK AND ALUMINUM-COPPER PISTONS

[75] Inventors: Raymond J. Donahue, Fond du Lac; Terrance M. Cleary, Allenton; Benjamin L. Sheaffer, Oshkosh, all of Wis.

[73] Assignee: Brunswick Corporation, Skokie, Ill.

[21] Appl. No.: 957,730

[22] Filed: Oct. 7, 1992

[51] Int. Cl.[5] ..... C22C 21/02; F02F 7/00; F02F 3/00

[52] U.S. Cl. ..... 123/193.4; 29/888.047

[58] Field of Search ..... 123/193.6, 193.2, 193.5, 123/193.3, 193.4; 29/888.04, 888.047, 888.06; 164/34

[56] References Cited

U.S. PATENT DOCUMENTS

| | | | |
|---|---|---|---|
| 4,008,051 | 2/1977 | Cadle | 123/193.6 |
| 4,432,313 | 2/1984 | Matlock | 123/193.6 |
| 4,483,286 | 11/1984 | Hermann et al. | 123/193.6 |
| 4,537,161 | 8/1985 | Huret et al. | 123/193.6 |
| 4,603,665 | 8/1986 | Hesterberg et al. | 123/195 |
| 4,643,079 | 2/1987 | Brann et al. | 123/193.6 |
| 4,651,630 | 3/1987 | Zeilinger et al. | 123/193.6 |
| 4,821,694 | 4/1989 | Hesterberg et al. | 123/195 |
| 4,875,517 | 10/1989 | Donahue et al. | 164/34 |
| 4,966,220 | 10/1990 | Donahue et al. | 164/34 |
| 4,969,428 | 11/1990 | Donahue et al. | 123/195 |
| 5,115,770 | 5/1992 | Yen et al. | 123/193.6 |
| 5,129,378 | 7/1992 | Donahue et al. | 123/193.2 |

OTHER PUBLICATIONS

"The Aluminum Industry", pp. 220–226; 626–631, Dec. 1930.

"Engineer Metals and Their Alloys", Samans, Dec. 1949, pp. 656–660.

"Structure and Properties of Alloys", Brick & Phillips, Dec. 1942.

"Aluminum 122", Alloy Digest, Feb. 1957.

"Aluminum A132", Alloy Digest, Oct. 1965.

"Aluminum 360 & A360", Alloy Digest, May 1961.

"Aluminum 390 & A390", Alloy Digest, Aug. 1971.

"Aluminum 392.0", Alloy Digest, Sep. 1970.

*Primary Examiner*—Tony M. Argenbright

*Assistant Examiner*—M. Macy

*Attorney, Agent, or Firm*—Andrus, Sceales, Starke & Sawall

[57] ABSTRACT

An internal combustion engine having an engine block containing a plurality of cylinder bores and a piston slidably mounted in each bore. The block is composed of a hypereutectic aluminum-silicon alloy containing from 16% to 30% silicon and having precipitated primary silicon crystals, while the piston is composed of an aluminum-copper alloy containing from 10% to 15% by weight of copper.

8 Claims, No Drawings

INTERNAL COMBUSTION ENGINE HAVING A HYPEREUTECTIC ALUMINUM-SILICON BLOCK AND ALUMINUM-COPPER PISTONS

BACKGROUND OF THE INVENTION

Aluminum-silicon alloys containing less than about 11.6% by weight of silicon are referred to as hypoeutectic alloys, while alloys containing more than 11.6% silicon are referred to as hypereutectic alloys.

Hypoeutectic aluminum-silicon alloys have a microstructure consisting of primary aluminum dendrites with a eutectic composed of acicular silicon in an aluminum matrix. On the other hand, hypereutectic aluminum-silicon alloys, those containing more than 11.6% silicon, contain primary silicon crystals which are precipitated as the alloy is cooled from solution temperature. Due to the large precipitated primary silicon crystals, these alloys have good wear resistant properties, but are difficult to machine, a condition which limits their use as casting alloys. While alloys of this type have good fluidity, they have a large or wide solidification range, and the solidification range will increase dramatically as the silicon content is increased.

Normally a solid phase in a "liquid plus solid" field has either a lower or higher density than the liquid phase, but almost never the same density. If the solid phase is less dense than the liquid phase, floatation of the solid phase will result. On the other hand, if the solid phase is more dense, a settling of the solid phase will occur. In either case, an increase or widened solidification range will increase the time period for solidification and accentuate the phase separation. With a hypereutectic aluminum-silicon alloy, the silicon particles have a lesser density than the liquid phase, so that the floatation condition prevails and the alloy solidifies with a large mushy zone because of its high thermal conductivity and the absence of skin formation typical of steel castings. As the solidification range is widened the tendency for floatation of large primary silicon particles increases, thus resulting in a less uniform distribution of large silicon particles in the cast alloy.

Hypereutectic aluminum-silicon alloys containing precipitated primary silicon crystals have had commercial applicability only because of their refinement of the primary silicon phase by phosphorous additions to the melt, as disclosed in U.S. Pat. No. 1,387,900. The addition of small amounts of phosphorous causes a precipitation of aluminum-phosphorous particles which serve as the active nucleant for the primary silicon phase. Due to the phosphorous refinement, the primary silicon particles are of a smaller size and have a more uniform distribution, so that the alloys can be used in applications requiring the manufacturing attribute of machinability, and the engineering attribute of wear resistance.

It has been found that if an engine block for an internal combustion engine, as well as the pistons, are both formed of a hypereutectic aluminum-silicon alloy, "pull out" damage and sub-surface cracking damage can occur at the mating surface interface, as the primary silicon particles in one of the mating surfaces contacts and attempts to dislodge the primary silicon particles in the other mating surface. To avoid this problem in the past, a harder metal, such as chromium or iron, has been plated on one, but not both of the mating surfaces. For example, in marine engines it has been proposed to plate the cylinder bores of a hypereutectic aluminum-silicon alloy engine block with chromium and utilize pistons of an unplated hypereutectic aluminum silicon alloy. It has also been known to utilize chromium plated pistons with linerless unplated hypereutectic aluminum silicon engine blocks. However, both of these systems require expensive chromium plating on one of the components to avoid the wear damage mentioned above.

In high performance racing engines, it has also been proposed to coat the cylinder bores of a hypereutectic aluminum silicon engine block with electroplated nickel and silicon carbide and utilize uncoated hypereutectic aluminum-silicon alloy pistons with this block. This combination has shown to be workable, because the silicon carbide particle size of the cylinder bore coating is much smaller than the primary silicon particle size of the aluminum-silicon alloy pistons, and because the hardness of the electroplated nickel is significantly greater than the hardness of the aluminum-alloy matrix of the hypereutectic aluminum-silicon alloy. In effect, the large primary silicon particles of the piston alloy do not dislodge the smaller silicon carbide particles because the hard nickel matrix resists the furrowing tendencies of the primary silicon particles.

The commercial problem with any of the above-mentioned piston and cylinder assemblies, is that the manufacturing cost is substantially higher than a typical cast iron engine block with uncoated hypereutectic aluminum-silicon alloy pistons, and secondly, the plating processes are not environmentally friendly.

Contrary to the problems that arise when running hypereutectic aluminum-silicon alloy pistons and cylinders directly on each other, cast iron surfaces can be run directly on each other. The cast iron/cast iron mating surface combinations apparently are workable because the insoluble graphite in the structure provides a solid lubricant at the mating surface interface. Along the same line, U.S. Pat. No. 4,297,976 describes an engine in which uncoated hypereutectic aluminum silicon alloy pistons were run in cylinder bores composed of a hypereutectic aluminum-silicon alloy containing a solid lubricant of tin, lead and/or molybdenum. However, it is difficult to cast an engine block of a hypereutectic aluminum-silicon alloy with insoluble constituents, such as tin, lead or molybdenum, and have the insoluble particles uniformly distributed at the bore surface. Even if the alloy containing the solid lubricants was employed only as a cylinder liner as opposed to the entire engine block, there would be a casting problem, because the insoluble particles have a higher density than aluminum, and in a centrifugal casting process, which is the preferred manner of producing liners, the heavier insoluble constituents would migrate away from the inner diameter surface, where they are necessary in providing the solid lubricity at the mating surface, to the outer diameter surface where they have no value.

SUMMARY OF THE INVENTION

The invention is directed to an internal combustion engine having an engine block formed of a hypereutectic aluminum-silicon alloy and having pistons that are composed of an aluminum copper alloy containing from 10% to 15% by weight of copper.

The hypereutectic aluminum-silicon engine block contains precipitated primary silicon crystals, and is preferably produced through phosphorous refinement in which a small amount of phosphorous causes a precipitation of aluminum-phosphorous particles which serve as the active nucleant for the primary silicon phase. Due to the phosphorous refinement, the primary silicon particles have a smaller size, generally less than 35 microns and have a more uniform distribution.

The aluminum-copper alloy used as the pistons has a microstructure consisting of primary aluminum-alloy dendrites that contain up to 5.5% copper in solution and a eutectic containing a continuous, intermetallic, brittle copper-aluminum phase.

The aluminum-copper pistons can be run directly against the hypereutectic aluminum-silicon alloy block without scuffing or "pull-out" damage, because the microstructures at the mating surfaces are different and compatible. This compatibility does not involve a solid lubricant, but instead is characterized by one mating surface of the aluminum-silicon alloy having hard discrete particles and by a second mating surface of the aluminum-copper alloy having a hard continuous phase.

By not having to plate or form a hard metal coating between the two aluminum alloy surfaces, there is a substantial benefit in manufacturing cost.

As both the pistons and the block are composed of aluminum alloys, the engine has improved thermal conductivity and lighter weight thereby providing engine design and performance advantages.

DESCRIPTION OF THE PREFERRED EMBODIMENT

The invention is directed to an internal combustion engine containing one or more cylinder bores each of which contains a piston. The engine can either be a two or four cycle engine.

In accordance with the invention, the engine block is formed of a hypereutectic aluminum-silicon alloy having the following general composition in weight percent:

| | |
|---|---|
| Silicon | 16.0%-30.0% |
| Magnesium | 0.4%-2.0% |
| Copper | Up to 5.0% |
| Manganese | Up to 0.5% |
| Iron | Up to 1.5% |
| Phosphorous | 0.005%-0.06% |
| Aluminum | Balance |

A specific example of an aluminum-silicon alloy to be used as the engine block is as follows in weight percent:

| | |
|---|---|
| Silicon | 20.10% |
| Magnesium | 1.10% |
| Copper | 0.15% |
| Manganese | 0.10% |
| Iron | 0.90% |
| Phosphorous | 0.015% |
| Aluminum | 77.64% |

The alloy has a Brinell hardness of 120.

The hypereutectic aluminum-silicon alloy contains primary silicon crystals which are precipitated as the alloy is cooled from solution temperature. Due to the preferred addition of phosphorous the primary silicon is refined, as disclosed in U.S. Pat. No. 1,387,900. The phosphorous causes a precipitation of aluminum-phosphorous particles that serve as an active nucleant for the primary silicon phase. Due to the phosphorous refinement, the primary silicon particles have a smaller size, generally less then 35 micron, and have a more uniform distribution than unrefined primary silicon particles, which can have a size up to 150 microns.

The hypereutectic aluminum-silicon alloy to be employed as the engine block has a tensile strength of 25,000 to 45,000 psi, a yield strength of 25,000 to 45,000 psi, an elongation in two inches of 0% to 1% and a Brinnel hardness in the range of 100 to 145.

The pistons which are adapted to run directly against the unplated and unlined cylinder bores of the block, are composed of an aluminum-copper alloy having the following composition in weight percent:

| | |
|---|---|
| Copper | 9.0%-15.0% |
| Iron | 0%-1.5% |
| Silicon | 0.5%-4.5% |
| Magnesium | 0%-0.5% |
| Manganese | 0%-1.5% |
| Nickel | 0%-1.5% |
| Zinc | 0%-1.5% |
| Chromium | 0%-0.3% |
| Vanadium | 0%-0.4% |
| Zirconium | 0%-0.7% |
| Molybdenum | 0%-0.3% |
| Titanium | 0%-0.3% |
| Aluminum | Balance |

A specific example of an aluminum-copper alloy falling within the above general range is as follows in weight percent:

| | |
|---|---|
| Copper | 10.45% |
| Iron | 1.25% |
| Silicon | 1.71% |
| Magnesium | 0.26% |
| Manganese | 0.52% |
| Nickel | 0.49% |
| Zinc | 0.71% |
| Chromium | 0.01% |
| Vanadium | 0.01% |
| Zirconium | 0.01% |
| Molybdenum | 0.01% |
| Titanium | 0.05% |
| Aluminum | 84.52% |

The alloy has a Brinell hardness of 150.

The aluminum-copper alloy to be utilized as the pistons has a microstructure consisting of primary aluminum alloy dendrites containing up to 5.5% copper in solution and a eutectic containing a continuous, brittle, intermetallic copper-aluminum phase.

The aluminum copper alloy in the heat treated state has a tensile strength in the range of 25,000 to 65,000 psi, a yield strength of 20,000 to 48,000 psi, a percent elongate in two inches of 0 to 3.0, and a Brinnel hardness of 80 to 160.

It has been recognized that high wear is associated with mating sliding surfaces that have the same microstructure. Without plated cylinder bores or cylinder liners, "pull-out" damage and subsurface cracking can occur if a hypereutectic aluminum-silicon piston is run directly against a hypereutectic aluminum-silicon cylinder bore. At the mating surface interface, the primary silicon particles in one of the mating surfaces contacts and tries to dislodge the primary silicon particles in the other mating surface. However, cast iron is an exception to the rule, and it is believed that cast iron/cast iron mating surface combinations are effective because the insoluble graphite in the structure acts as a solid lubricant at the mating surface interface. However, alloying a solid lubricant, such as tin, lead or molybdenum in a hypereutectic aluminum-silicon an engine block is not commercially feasible, for it is difficult to cast an engine block and have the insoluble particles uniformly distributed at the cylinder bore surface.

Attempts have been made in the past, to use pistons containing approximately 10% copper in conjunction with cast iron engine blocks. However, the use of this combination was not successful and was discontinued because the high coefficient of thermal expansion of the aluminum-copper alloy. Because of the high thermal expansion coefficient of aluminum-copper alloy, which requires a larger than normal clearance in a cast iron cylinder bore, the engine is noisy until warm. Therefore, aluminum-copper alloys have not been considered to be candidates for pistons for today's internal combustion engines. If an aluminum alloy piston was required, the natural tendency would be to use aluminum silicon alloys, with solid lubricants, while the heavier, less castable, higher thermal expansion coefficient and less ductile aluminum-copper alloys would not be considered. However, through the invention it has been discovered that the microstructure compatibility of aluminum-copper alloy pistons with hypereutectic aluminum-silicon alloys exhibits unexpectedly high wear resistance for piston/cylinder bore assemblies of two-stroke engines that see salt water usage, as well as four-stroke engines that do not need corrosion resistance for salt water usage.

Aluminum-copper alloy pistons can be run directly against the hypereutectic aluminum-silicon cylinder bore, without scuffing because the microstructures at the mating surfaces are compatible. The compatibility does not involve a solid lubricant, but instead is characterized by one mating surface of the hypereutectic aluminum-silicon alloy having hard discrete particles, and by a second mating surface of a copper-aluminum alloy having hard continuous phases.

Unlike commercial alloys having a typical aluminum-silicon-copper system, the primary aluminum dendrites in the aluminum-copper alloy used in the pistons are much harder due to the fact that up to 5.5% by weight of copper is in solution in the aluminum. In addition, the structure of the eutectic in the aluminum-copper system is characterized by a microstructure that has a brittle intermetallic compound as a continuous phase in the eutectic structure. By contrast, in the aluminum-silicon system, the continuous phase in the eutectic is the ductile aluminum phase. The aluminum-copper alloy, has a wear resistance not dependent on hard discrete particles, and thus is not subject to particle dislodgement. Further, unlike hypoeutectic aluminum-silicon alloys, the aluminum-copper alloy has high resistance to furrowing or scraping from angular primary silicon particles in a mating surface of a hypereutectic aluminum-silicon alloy. This is due to the fact that the primary aluminum phase in the aluminum-copper alloy, with its high level of dissolved copper, imparts a high resistance to this wear mechanism.

The invention eliminates the necessity of plating either the piston or the cylinder bore, and thus reduces the manufacturing cost of the engine. As both the piston, as well as the engine block are composed of aluminum alloys, high heat conductivity and lightweight are achieved, which give engine design performance advantages. The improved heat conductivity imparts a resistance to carbon deposits in the ring grooves of the piston, because the walls of the combustion chamber stabilize quickly at a lower temperature, as opposed to the use of cast iron engine blocks.

The invention provides an engine having hypereutectic aluminum-silicon cylinder bores, free of insoluble lubricants that limit castability, low in copper to provide good corrosion resistance, low in iron to achieve functional ductilitry in commercial applications, and capable of running directly in contact with lightweight aluminum-copper pistons without scuffing or damage.

Various modes of carrying out the invention contemplated as being within the scope of the following claims particularly pointing out and distinctly claiming the subject matter which is regarded as the invention.

We claim:

1. An internal combustion engine, comprising a cast engine block having at least one cylindrical bore and a piston disposed to move in direct contact with said bore, said block composed of a hypereutectic aluminum-silicon alloy containing from 16% to 30% by weight of silicon and having precipitated silicon particles distributed throughout said alloy, said piston being composed of an aluminum-copper alloy containing from 10% to 15% by weight of copper and having a eutectic containing a continuous copper-aluminum phase.

2. The engine of claim 1, wherein said aluminum-silicon alloy has the following composition in weight percent:

| | |
|---|---|
| Silicon | 16.0%-30.0% |
| Magnesium | 0.4%-2.0% |
| Copper | Up to 5.0% |
| Manganese | Up to 0.5% |
| Iron | Up to 1.5% |
| Phosphorous | 0.005%-0.06% |
| Aluminum | Balance |

and the aluminum copper alloy has the following composition in weight percent:

| | |
|---|---|
| Copper | 9.0%-15.0% |
| Iron | 0%-1.5% |
| Silicon | 0.5%-4.5% |
| Magnesium | 0%-0.5% |
| Manganese | 0%-1.5% |
| Nickel | 0%-1.5% |
| Zinc | 0%-1.5% |
| Chromium | 0%-0.3% |
| Vanadium | 0%-0.4% |
| Zirconium | 0%-0.7% |
| Molybdenum | 0%-0.3% |
| Titanium | 0%-0.3% |
| Aluminum | Balance. |

3. The engine of claim 2, wherein said aluminum-copper alloy has a microstructure consisting of primary aluminum dendrites containing up to 5.5% of copper in solution and a eutectic containing a continuous intermetallic copper-aluminum phase.

4. The engine of claim 2, wherein said aluminum-silicon alloy engine block is free of insoluble lubricant particles.

5. The engine of claim 2, wherein said aluminum-copper alloy in the heat treated state has a yield strength in the range of 20,000 to 48,000 psi, a tensile strength of 25,000 to 65,000 psi, an elongation in two inches of 0% to 3.0% and a Brinnel hardness in the range of 80 to 160.

6. The engine of claim 2, wherein said primary silicon crystals in said aluminum silicon alloy have an average particle size less than 35 microns.

7. An internal combustion engine, comprising an engine block having a plurality of cylindrical bores, and a piston mounted for sliding movement within each bore, said block being composed of an hypereutectic aluminum-silicon alloy having the following composition in weight percent:

| | |
|---|---|
| Silicon | 16.0%-30.0% |
| Magnesium | 0.4%-2.0% |
| Copper | Up to 5.0% |
| Manganese | Up to 0.5% |
| Iron | Up to 1.5% |
| Phosphorous | 0.005%-0.06% |
| Aluminum | Balance |

said piston being composed of an aluminum-copper alloy having the following composition in weight percent:

| | |
|---|---|
| Copper | 9.0%-15.0% |
| Iron | 0%-1.5% |
| Silicon | 0.5%-4.5% |
| Magnesium | 0%-0.5% |
| Manganese | 0%-1.5% |
| Nickel | 0%-1.5% |
| Zinc | 0%-1.5% |
| Chromium | 0%-0.3% |
| Vanadium | 0%-0.4% |
| Zirconium | 0%-0.7% |
| Molybdenum | 0%-0.3% |
| Titanium | 0%-0.3% |
| Aluminum | Balance. |

8. The engine of claim 7, wherein said hypereutectic aluminum-silicon alloy contains precipitated crystals of primary silicon and said aluminum-copper alloy has a microstructure consisting of primary aluminum alloy dendrites containing up to 5.5% of copper in solution and a eutectic containing a continuous intermetallic brittle copper-aluminum phase.

* * * * *